US011572886B1

(12) United States Patent
Pyron et al.

(10) Patent No.: US 11,572,886 B1
(45) Date of Patent: Feb. 7, 2023

(54) ELECTRICAL SUBMERSIBLE PUMP (ESP) SEAL SECTION SERVICE-LESS FLANGE

(71) Applicant: Halliburton Energy Services, Inc., Houston, TX (US)

(72) Inventors: Steven Pyron, Tulsa, OK (US); Jeffrey Frey, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 11 days.

(21) Appl. No.: 17/505,071

(22) Filed: Oct. 19, 2021

(51) Int. Cl.

| | |
|---|---|
| ***F04D 29/12*** | (2006.01) |
| ***F04D 13/08*** | (2006.01) |
| ***E21B 43/12*** | (2006.01) |
| ***F04D 29/04*** | (2006.01) |
| ***F04D 29/02*** | (2006.01) |

(52) U.S. Cl.
CPC ..... *F04D 29/126* (2013.01); *E21B 43/128* (2013.01); *F04D 13/086* (2013.01); *F04D 29/026* (2013.01); *F04D 29/0405* (2013.01)

(58) Field of Classification Search
CPC ..... F04D 29/126; F04D 29/026; F04D 29/0405; F04D 13/086; F04D 13/021; F04D 13/10; E21B 43/128; E21B 17/02; F16D 1/108; F16D 2001/103; F05D 2260/30; F05D 2260/36
See application file for complete search history.

(56) References Cited

U.S. PATENT DOCUMENTS

| | | | |
|---|---|---|---|
| 6,883,604 B2 | 4/2005 | Mack et al. | |
| 8,419,390 B2 | 4/2013 | Merrill et al. | |
| 9,080,436 B2 | 6/2015 | Tetzlaff et al. | |
| 9,995,118 B2 * | 6/2018 | Tanner | F04D 29/061 |
| 10,473,106 B2 | 11/2019 | Parmeter et al. | |

(Continued)

FOREIGN PATENT DOCUMENTS

| | | |
|---|---|---|
| EP | 3472425 A1 | 4/2019 |
| RU | 2011127912 A | 1/2013 |
| WO | 2018039086 A1 | 3/2018 |

OTHER PUBLICATIONS

Foreign Communication from Related Application—International Search Report and Written Opinion of the International Searching Authority, International Application No. PCT/US2022/040035, dated Nov. 25, 2022, 10 pages.

*Primary Examiner* — Woody A Lee, Jr.
*Assistant Examiner* — Joshua R Beebe
(74) *Attorney, Agent, or Firm* — Conley Rose, P.C.; Rodney B. Carroll

(57) ABSTRACT

An electric submersible pump (ESP) seal section assembly. The assembly comprises a seal section filled with dielectric oil; a coupling body partially inserted into the seal section, and a coupling body, wherein the coupling body is substantially cylindrical and has a first outside diameter at an upper end of the coupling body, has a second outside diameter smaller than the first diameter below the first outside diameter, has a circumferential tapered shoulder between the portion of the coupling body having the first diameter and the portion of the coupling body having the second diameter; a service-less flange coupled to the seal section, wherein the service-less flange defines a circumferential opening having a circumferential tapered shoulder on an upper edge that contacts the circumferential tapered shoulder of the coupling body.

20 Claims, 5 Drawing Sheets

(56) References Cited

U.S. PATENT DOCUMENTS

| | | | | |
|---|---|---|---|---|
| 10,502,221 | B2 * | 12/2019 | Meyer | E21B 43/128 |
| 2009/0202371 | A1 * | 8/2009 | Green | F04C 13/008 417/423.3 |
| 2010/0150751 | A1 * | 6/2010 | Merrill | H02K 5/132 277/336 |
| 2011/0171047 | A1 * | 7/2011 | Parmeter | F04B 47/02 29/525.02 |
| 2020/0063541 | A1 * | 2/2020 | Davis | E21B 43/128 |

* cited by examiner

ELECTRICAL SUBMERSIBLE PUMP (ESP) SEAL SECTION SERVICE-LESS FLANGE

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Electric submersible pumps (ESPs) are installed in wellbores to lift production fluids up within a wellbore to a surface location. ESPs commonly comprise assemblies of collaborating components including a centrifugal pump, upstream of the centrifugal pump an optional gas separator, upstream of the optional gas separator a fluid inlet, upstream of the fluid inlet a seal unit, upstream of the seal unit an electric motor, and upstream of the electric motor an optional sensor package. An electric cable extends from the surface down the wellbore to the electric motor and supplies power from a surface located electrical power source (e.g., a variable speed drive) to the electric motor. The electric motor turns a drive shaft that is coupled via other drive shafts within the ESP assembly to provide power the optional gas separator and to the centrifugal pump. For example, a drive shaft in the seal section is mechanically coupled to the drive shaft in the electric motor; the drive shaft in the seal section is mechanically coupled to a drive shaft in the optional gas separator, and the drive shaft in the optional gas separator is mechanically coupled to a drive shaft in the centrifugal pump. When the drive shaft of the electric motor turns (e.g., when electric power is provided via the electric cable to the electric motor), the drive shaft in the seal section is turned; when the drive shaft in the seal section is turned, the drive shaft in the optional gas separator turns, providing motive force to components within the optional gas separator; when the drive shaft in the optional gas separator turns, the drive shaft in the centrifugal pump turns, providing motive force to the centrifugal pump stages of the centrifugal pump. When the ESP assembly is disposed and operated downhole in the wellbore, an interior of the seal section is in fluid communication with an interior of the electric motor, and the seal section provides dielectric oil to the electric motor as well as pressure equalization between an outside of the ESP assembly and the interior of the electric motor.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
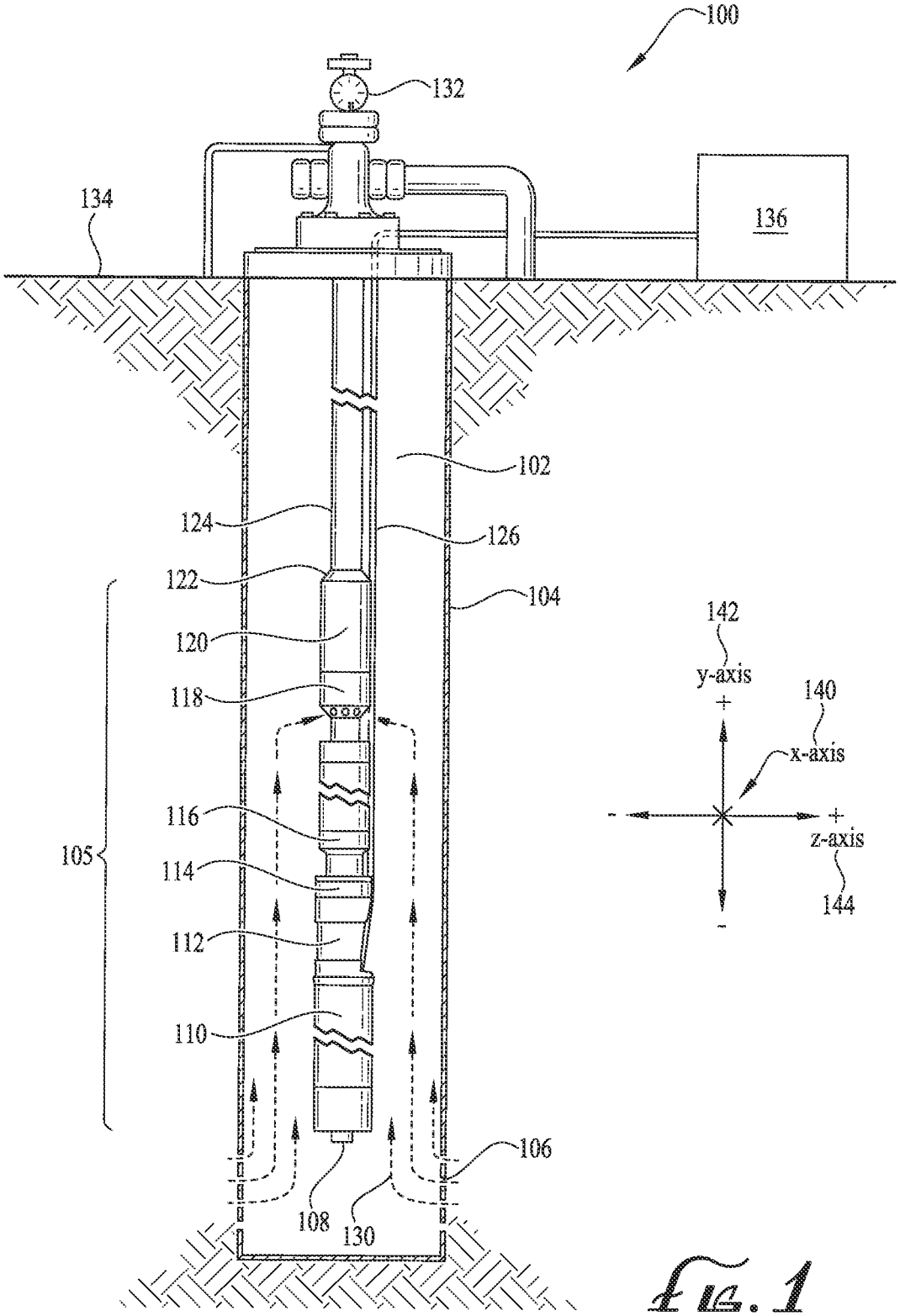
FIG. 1 is an illustration of a wellbore and an electric submersible pump (ESP) assembly according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "upstream," "downstream," "up," "down," "uphole," and "downhole" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" and "downhole" are directed counter to the direction of flow of well fluid, towards the source of well fluid. "Up" and "uphole" are directed in the direction of flow of well fluid, away from the source of well fluid. A "lower" portion of a component is a portion of the component located at a "downhole" end or "downhole" portion of the component; an "upper" portion of a component is a portion of the component located at an "uphole" end or "uphole" portion of the component.

Conventionally, when an ESP assembly is made up at a wellsite, the electric motor is suspended over the wellbore (e.g., by slips in a rig floor) and a seal section is bolted onto or otherwise mechanically coupled to the electric motor. This process often includes the process of filling the seal section with dielectric oil or topping up the seal section with dielectric oil. But the rig location may not be amenable to precision operations. Rig hands may not properly fill the seal section with dielectric oil and the seal section may be only partially filled when made up with the electric motor. Partly this may be due to the viscous quality of the dielectric oil in some environments and partly this may be due to the labyrinthine interior passageways of some seal sections. Additionally, contaminants may infiltrate the seal section. The present disclosure teaches a new service-less flange that permits completely filling the seal section with dielectric oil at a shop location (e.g., at an original equipment manufacturer (OEM) location) under controlled conditions, sealing the interior of the seal section to retain the complete charge of dielectric oil within the seal section, transporting the seal section coupled with the service-less flange to the wellsite, and making up the seal section and service-less flange to the electric motor without spilling the dielectric oil, without contaminating the dielectric oil, and without the need to top-up the dielectric oil in the seal section at the wellsite. In addition to assuring that the seal section is fully charged with dielectric oil that is uncontaminated when it is made up with the electric motor at the wellsite, the use of the service-less flange taught herein reduces the time involved in making up the ESP assembly, because the procedure of filling and/or topping up the dielectric oil in the seal section is avoided, thereby reducing non-productive downtime.

Turning now to FIG. 1, a wellsite 100 is described. The wellsite 100 comprises a wellbore 102 optionally lined with a casing 104, an electric submersible pump (ESP) assembly 105 in the wellbore 102, and a production tubing string 124. The ESP assembly 105 comprises an optional sensor unit 108 at a downhole end, an electric motor 110 coupled to the sensor unit 108 uphole of the sensor unit 108, an optional motor head 112 coupled to the electric motor 110 uphole of the electric motor 110, a service-less flange 114 coupled to the motor head 112 uphole of the motor head 112, a seal section 116 coupled to the service-less flange 114 uphole of the service-less flange 114, a fluid inlet 118 coupled to the seal section 116 uphole of the seal section 116, a centrifugal pump assembly 120 coupled to the fluid inlet 118 uphole of the fluid inlet 118, and a pump discharge 122 coupled to the centrifugal pump assembly 120 uphole of the centrifugal pump assembly 120. The pump discharge 122 is coupled to the production tubing string 124.

In an embodiment, the casing 104 has perforations 106 that allow production fluid 130 to enter the wellbore 102 and flow downstream to the fluid inlet 118. The reservoir fluid 130 is pumped by the centrifugal pump assembly 126 to flow out of the centrifugal pump assembly 126 into the pump discharge 122 up the production tubing string 124 a wellhead 132 located at the surface 134. In an embodiment, an electric cable 126 is connected to the electric motor 110 and provides electric power from an electric power source 136 located at the surface 134 to the electric motor 110 to cause the electric motor 110 to turn and deliver rotational power to the centrifugal pump assembly 120.

It is understood that the ESP assembly 105 may have other components that are not illustrated in FIG. 1. For example, in a well bore 102 where production fluid 130 contains some gas phase fluid mixed with liquid phase fluid, the ESP assembly 105 may further comprise a gas separator (not shown) disposed between the seal section 116 and the centrifugal pump assembly 120, for example between the fluid inlet 118 and the centrifugal pump assembly 120. In an embodiment, the centrifugal pump assembly 120 comprises a drive shaft and one or more centrifugal pump stages, where each centrifugal pump stage comprises an impeller mechanically coupled to the drive shaft and a diffuser statically retained within a housing of the centrifugal pump assembly 120. An orientation of the wellbore 102 and the ESP assembly 105 is illustrated in FIG. 1 by an x-axis 140, a y-axis 142, and a z-axis 144. While the wellbore 102 is illustrated in FIG. 1 as being substantially vertical, the teachings of the present disclosure are applicable to wellbores that have a deviated portion or a substantially horizontal portion.

Figure 2A:
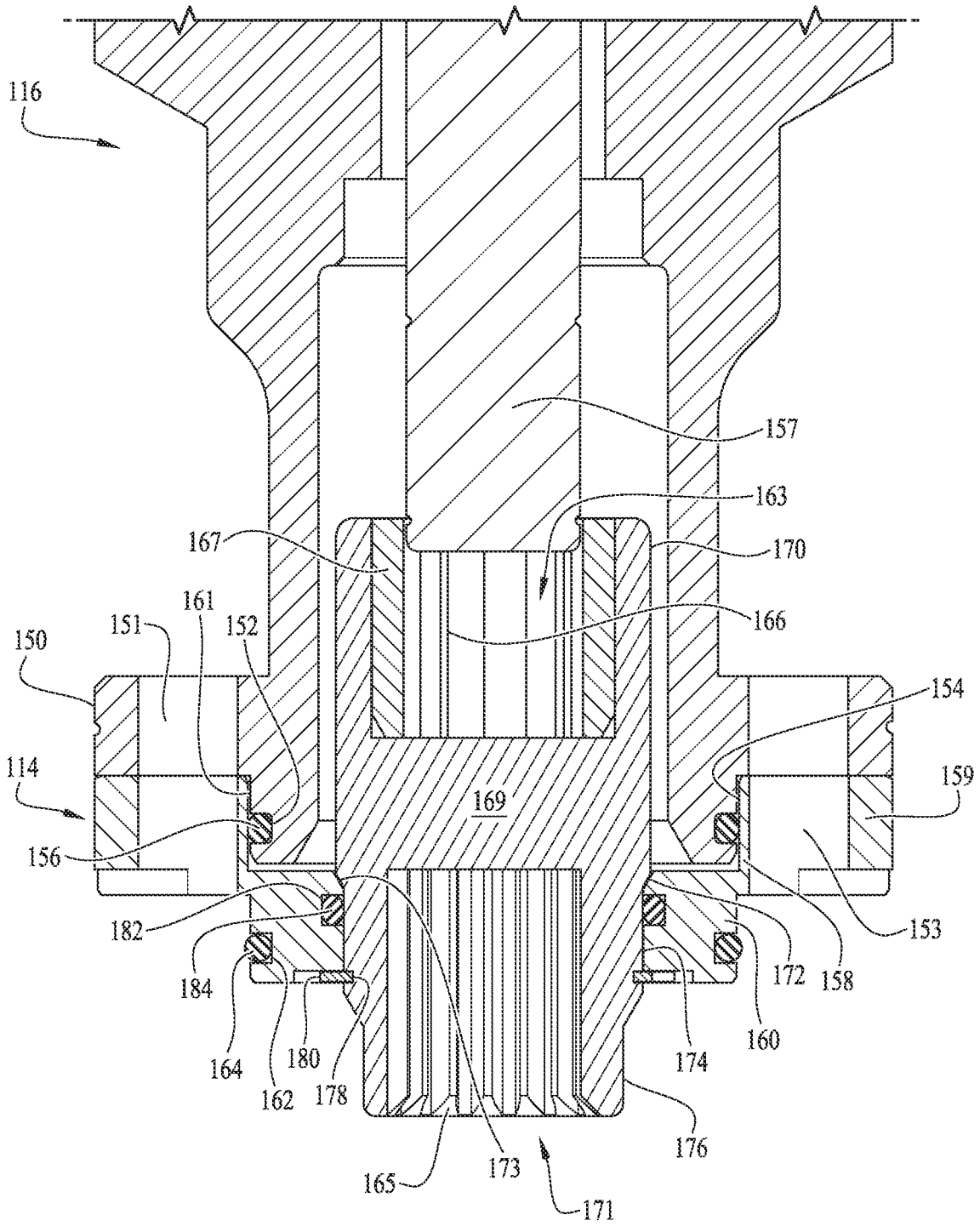
FIG. 2A is an illustration of a service-less flange coupled to a seal section according to an embodiment of the disclosure.

Turning now to FIG. 2A, further details of the service-less flange 114 and the seal section 116 are described. The service-less flange 114 comprises an upper portion 159 having an inner wall 158 and a lower portion 160. The lower end of the seal section 116 has a circumferential groove 152 in which a first O-ring 156 is disposed. The first O-ring 156 makes a seal between interior face 154 of the inner wall 158 of the service-less flange 114 and the lower end of the seal section 116 that prevents dielectric oil in an interior of the seal section 116 from leaking past the interface between the interior face 154 of the service-less flange 114 and an exterior surface 161 of the lower end of the seal section 116. A base 150 of the seal section 116 has bolt holes 151 that align with bolt holes 153 in the upper portion 159 of the service-less flange 114. The lower portion 160 of the service-less flange 114 has a second circumferential groove 162 in which a second O-ring 164 is disposed. In an embodiment, the second O-ring 164 may not be installed into the second circumferential groove 162 until the ESP assembly 105 is made-up at the wellsite 100.

As depicted in FIG. 2A, a coupling body 169 is retained by the service-less flange 114. When the ESP assembly 105 is made-up at the wellsite 100 the coupling body 169 is released from the service-less flange 114 as described further below with reference to FIG. 3. The coupling body 169 is substantially cylindrical and has a first outside diameter at an upper end 170 of the coupling body 169, has a second outside diameter smaller than the first outside diameter in a middle portion 174 of the coupling body 169, and has a third outside diameter smaller than the second outside diameter at a lower end 176 of the coupling body 169. A first tapered shoulder 172 is formed between the upper end 170 and the middle portion 174 of the coupling body 169.

An upper end of the coupling body 169 retains a coupling sleeve 167 that has an opening 163 and that defines first female splines 166. The coupling sleeve 167 may be retained within the coupling body 169 by metal dowels that are inserted in axial grooves formed in an inside of the coupling body 169 and formed in an outside of the coupling sleeve 167. A lower end of the coupling body 169 has an opening 171 and defines second female splines 165. The first female splines 166 will mate with male splines of a drive shaft 157 of the seal section 116, and the second female splines 165 will mate with male splines of a drive shaft of the electric motor 110 when the seal section 116 and service-less flange 114 assembly are made-up with the motor head 112 and the electric motor 110, thereby mechanically coupling the drive shaft of the electric motor 110 to the drive shaft 157 of the seal section 116.

The service-less flange 114 defines a second tapered shoulder 173 that mates with the first tapered shoulder 172 and prevents the coupling body 169 from moving out of the service-less flange 114 in a downward direction. The coupling body 169 has a third circumferential groove 178. In the configuration depicted in FIG. 2A, a retainer 180 is disposed in the third circumferential groove 178 and prevents the coupling body 169 from moving into the seal section 116 in an upward direction. Thus, in the configuration depicted in FIG. 2A, the combination of the tapered shoulder 173 and the retainer 180 immobilizes the coupling body 169 and prevents it from moving downwards or upwards. It is understood that the function of the retainer 180 depicted in FIG. 2A may be performed by a variety of retainers including a retaining ring, a retaining clip, or a snap-ring.

The service-less flange 114 has a fourth circumferential groove 182 on its inside circumference, and a third O-ring 184 is disposed in the fourth circumferential groove 182. The third O-ring 184 makes a seal between an outside surface of the middle portion 174 of the coupling body 169 and an inside of the service-less flange 114 that prevents dielectric oil in the interior of the seal section 116 from leaking at this point. Thus, the seal provided by the first O-ring 156 and the third O-ring 184 prevent leaking of dielectric oil from the interior of the seal section 116 in the configuration depicted in FIG. 2A. The service-less flange 114 may be secured to the base 150 of the seal section 116 in the configuration depicted in FIG. 2A with wire and/or metal bands. The seal section 116 and the service-less flange 114 may be assembled in the configuration depicted in FIG. 2A and the seal section 116 filled with dielectric oil at a shop, for example in a manufacturing site. The seal section 116 and the service-less flange 114 assembly may be transported in the configuration depicted in FIG. 2A from the shop to the wellsite 100. At the wellsite 100, the seal section 116 and the service-less flange 114 assembly may then be assembled with the electric motor 110 and the motor head 112 and with the fluid inlet 118 and the centrifugal pump assembly 120 as described further hereinafter.

The first O-ring 156, the second O-ring 164, and the third O-ring 184 may be made of the same material or of different materials. In an embodiment, the O-rings 156, 164, 184 comprise an elastic deformable material that resists compression, whereby to make a seal. The O-rings may comprise nitrile (buna-N), neoprene, ethylene propylene rubber, ethylene propylene diene monomer rubber (EPDM rubber), silicone, fluoroelastomer, FKM, fluorocarbon (VITON), perfluoroelastomer (FFKM), tetrafluoro ethylene/propylene rubber (FEPM), or PTFE (TEFLON). The O-rings, in addition to elastomeric material, may comprise fillers such as carbon black and/or calcium carbonate, as well as plasticisers such as paraffinic oils.

Figure 2B:
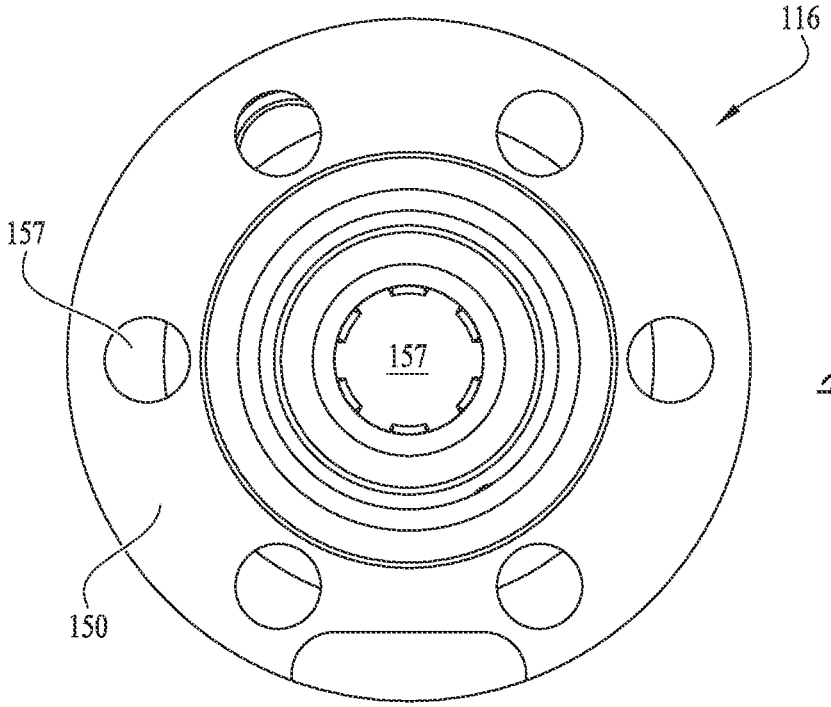
FIG. 2B is an illustration of the seal section according to an embodiment of the disclosure.
Figure 2C:
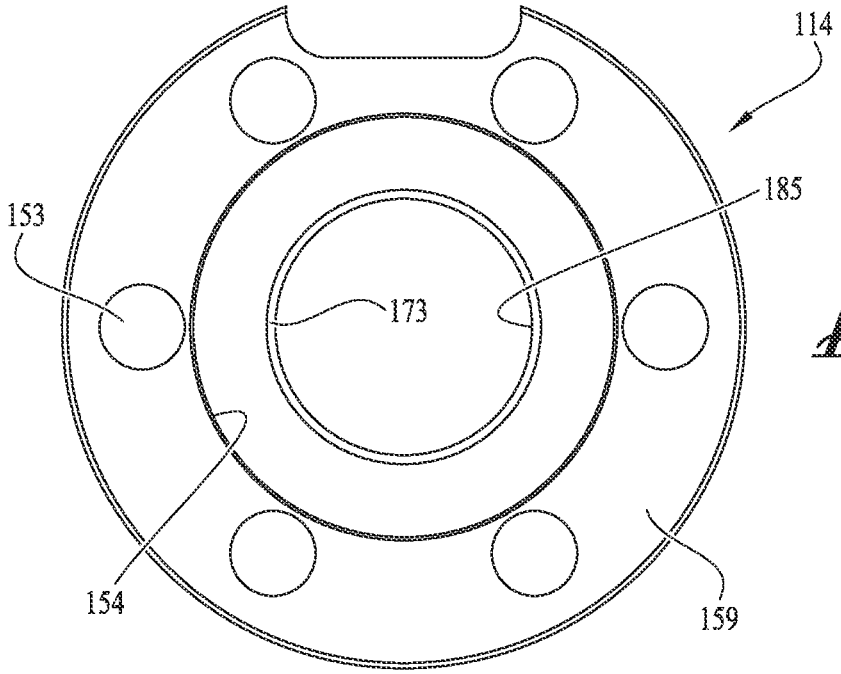
FIG. 2C is an illustration of the service-less flange according to an embodiment of the disclosure.

Turning now to FIG. 2B, the seal section 116 is depicted in a view looking along a central axis of the seal section 116 from below. The base 150 is circular or cylindrical in shape, excepting a cut-out area that is configured to receive the electric cable 126. The outside of the of the seal section above the base 150 can be seen through the bolt holes 157 and is cylindrical in shape. In an embodiment, the outside of the seal section 116 may have a tubular shape. Turning now to FIG. 2C, the service-less flange 114 is depicted in a view looking along a central axis of the service-less flange 114. The service-less flange 114 is substantially circular and/or cylindrical in shape, excepting a cut-out area that is configured to receive the electric cable 126. The inside of the service-less flange 114 has an inside wall 185.

Figure 3:
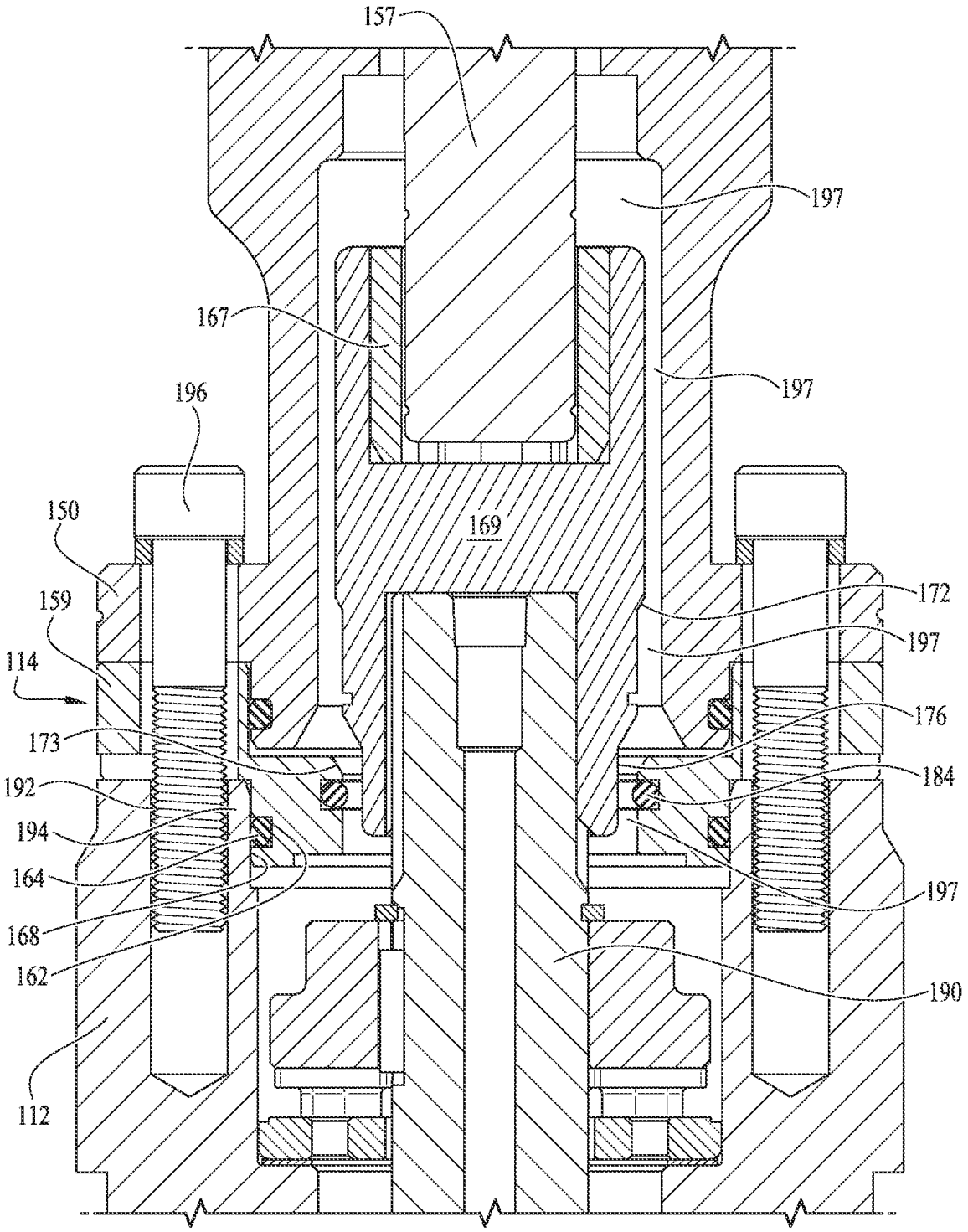
FIG. 3 is an illustration of a seal section service-less flange coupled to a seal section and to an electric motor head according to an embodiment of the disclosure.

Turning now to FIG. 3, further details of coupling the seal section 116 and service-less flange 114 assembly to the motor head 112 are described. The motor head 112 has bolt holes with threads 192 that couple to bolts 196 that run through bolt holes in the base 150 of the seal section 116 and through bolt holes in the upper portion 159 of the service-less flange 114 to couple the seal section 116 and the service-less flange 114 to the motor head 112. Before the seal section 116 and service-less flange 114 assembly makes-up with the motor head 112 and the electric motor 110, the retainer 180 that prevents the coupling body 169 from moving upwards is removed. This may be done while the electric motor 110 and the motor head 112 are hung over the wellbore 102, for example from slips in a rig floor, and while the seal section 116 and the service-less flange 114 assembly is suspended vertically above the motor head 112. In this position, the head of dielectric oil inside the seal section 116 may be expected to urge the coupling body 169 downwards, causing the first tapered shoulder 172 of the coupling body 169 to engage with the second tapered shoulder 173 of the service-less flange 114.

As the service-less flange 114 and the seal section 116 assembly mates with the motor head 112, male splines of a drive shaft 190 of the electric motor mate with female splines 165 of the coupling body 169. As the service-less flange 114 and the seal section 116 assembly continues to be lowered, first the second O-ring 164 makes a seal between a surface 168 of an inside wall 194 of the motor head 112 and the lower portion 160 of the service-less flange 114, then the drive shaft 190 of the electric motor 110 urges the coupling body 169 upwards, releasing the seal made by the third O-ring 184 between the outside surface of the middle portion 174 of the coupling body 169 and the inside of the service-less flange 114. As the drive shaft 190 of the electric motor 110 urges the coupling body 169 upwards, it causes female splines 166 of the coupling sleeve 167 to fully mate with male splines of the drive shaft 157 of the seal section 116. In an embodiment, the lower end of the male splines of the drive shaft 157 of the seal section 116 may be partially matted with the female splines 166 of the coupling sleeve 167 in the configuration illustrated in FIG. 2A.

When the seal made by the third O-ring 184 is released, the dielectric oil in the interior of the seal section 116 is in fluid communication with the dielectric oil in the interior of the electric motor 110 (e.g., fluid communication is via an annulus 197 defined between an interior wall of the seal section 116 and the outside of the coupling body 169, defined between an interior of the service-less flange 114 and an outside of the coupling body 169, and between the drive shaft 190 of the electric motor 110 and the motor head 112). It is noted that the sequence of first making the seal by the second O-ring 164 before breaking the seal by the third O-ring 184 prevents dielectric oil escaping the seal section 116, avoids making a mess at the wellsite 100, and avoids having to top-up the seal section 116 with additional dielectric oil which otherwise might be needful if spillage occurs.

Figure 4:
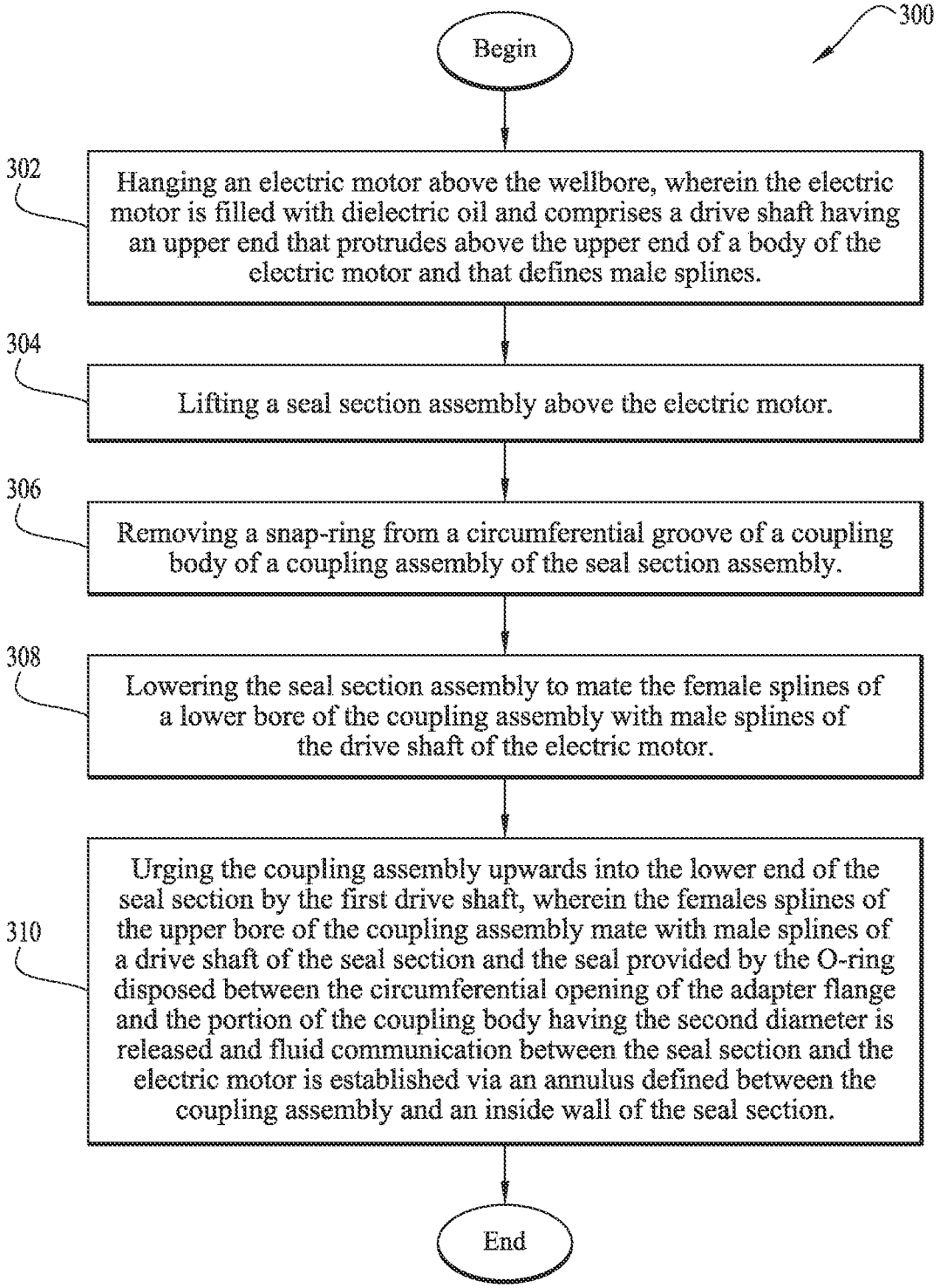
FIG. 4 is a flow chart of a method according to an embodiment of the disclosure.

Turning now to FIG. 4, a method 300 is described. In an embodiment, the method 300 is a method of assembling an electric submersible pump (ESP) assembly and running it into a wellbore. At block 302, the method 300 comprises hanging an electric motor above the wellbore, wherein the electric motor is filled with dielectric oil and comprises a drive shaft having an upper end that protrudes above the upper end of the electric motor and that defines male splines. In an embodiment, a motor head is coupled to the top of the electric motor, and the drive shaft of the electric motor protrudes above the top of the motor head.

At block 304, the method 300 comprises lifting a seal section assembly above the electric motor. The seal section assembly comprises a seal section having a drive shaft, wherein the seal section is filled with dielectric oil; a coupling assembly partially inserted into an opening at the lower end of the seal section and having a lower bore defining female splines for mating with male splines of an upper end of an electric motor drive shaft, an upper bore defining female splines for mating with male splines of a lower end of the seal section drive shaft, and a coupling body, wherein the coupling body is substantially cylindrical and has a first outside diameter at an upper end of the coupling body, has a second outside diameter smaller than the first diameter below the portion of the coupling body having the first outside diameter, has a circumferential tapered shoulder between the portion of the coupling body having the first diameter and the portion of the coupling body having the second diameter, has a circumferential groove at the lower end of the portion of the coupling body having the second outside diameter, has a third outside diameter smaller than the second diameter below the portion of the coupling body having the second outside diameter; a service-less flange coupled to a lower end of the seal section, wherein the service-less flange defines a circumferential opening having a circumferential tapered shoulder on an upper edge that contacts the circumferential tapered shoulder of the coupling body; a retainer (e.g., a retaining ring, a retaining clip, or a snap-ring) disposed in the circumferential grove of the coupling body that contacts a lower edge of the service-less flange; and an O-ring disposed between a circumferential groove in the circumferential opening of the service-less flange and the portion of the coupling body having the second diameter that provides a seal to retain the dielectric oil within the seal section. In an embodiment, the seal section assembly comprises a second O-ring disposed in a second circumferential groove in an outside of a lower portion of the service-less flange.

At block 306, the method 300 comprises removing the retainer from the circumferential groove of the coupling body. At block 308, the method 300 comprises lowering the seal section assembly to mate the female splines of the lower bore of the coupling assembly with male splines of the drive shaft of the electric motor.

At block 310, the method 300 comprises urging the coupling assembly upwards into the lower end of the seal section by the drive shaft of the electric motor, wherein the female splines of the upper bore of the coupling assembly mate with male splines of the drive shaft of the seal section and the seal provided by the O-ring disposed between the circumferential opening of the service-less flange and the portion of the coupling body having the second diameter is released and fluid communication between the seal section and the electric motor is established via an annulus defined between the coupling assembly and an inside wall of the seal section. In an embodiment, the processing of block 310 of method 300 comprises urging the coupling assembly upwards into the lower end of the seal section by the first drive shaft, wherein the female splines of the upper bore of the coupling assembly mate with male splines of the drive shaft of the seal section, wherein the second O-ring engages with an inside diameter of the motor head making a second seal, and wherein the first seal provided by the first O-ring disposed between the first circumferential groove in the circumferential opening of the service-less flange and the portion of the coupling body having the second diameter is released after the second seal is established and fluid communication between the seal section and the electric motor is established via an annulus defined between the coupling assembly and an inside wall of the seal section.

ADDITIONAL EMBODIMENTS

The following are non-limiting, specific embodiments in accordance with the present disclosure:

A first embodiment, which is an electric submersible pump (ESP) seal section assembly, comprising a seal section having a seal section drive shaft, wherein the seal section is filled with dielectric oil; a coupling body partially inserted into an opening at the lower end of the seal section and having a lower bore defining female splines for mating with male splines of an upper end of an electric motor drive shaft, and an upper bore defining female splines for mating with male splines of a lower end of the seal section drive shaft, wherein the coupling body is substantially cylindrical and has a first outside diameter at an upper end of the coupling body, has a second outside diameter smaller than the first diameter below the portion of the coupling body having the first outside diameter, has a circumferential tapered shoulder between the portion of the coupling body having the first diameter and the portion of the coupling body having the second diameter, has a circumferential groove at the lower end of the portion of the coupling body having the second outside diameter, has a third outside diameter smaller than the second diameter below the portion of the coupling body having the second outside diameter; a service-less flange coupled to a lower end of the seal section, wherein the service-less flange defines a circumferential opening having a circumferential tapered shoulder on an upper edge that contacts the circumferential tapered shoulder of the coupling body; a retainer disposed in the circumferential grove of the coupling body that contacts a lower edge of the service-less flange; and an O-ring disposed between a circumferential groove in the circumferential opening of the service-less flange and the portion of the coupling body having the second diameter that provides a seal to retain the dielectric oil within the seal section.

A second embodiment, which is the ESP seal section of the first embodiment, wherein the O-ring comprises Nitrile.

A third embodiment, which is the ESP seal section of the first embodiment, wherein the O-ring comprises perfluoroelastomer (FFKM).

A fourth embodiment, which is the ESP seal section of the first embodiment, wherein the O-ring comprises ethylene propylene diene monomer rubber (EPDM rubber)

A fifth embodiment, which is the ESP seal section of any of the first through the fourth embodiments, wherein the O-ring comprises carbon black.

A sixth embodiment, which is the ESP seal section of any of the first through the fifth embodiments, wherein the O-ring comprises calcium carbonate.

A seventh embodiment, which is the ESP seal section of any of the first through the sixth embodiments, wherein the O-ring comprises plasticisers.

An eighth embodiment, which is the ESP seal section of any of the first through the seventh embodiments, wherein female splines of the upper bore of the coupling assembly are different from the female splines of the lower bore of the coupling assembly.

A ninth embodiment, which is the ESP seal second of any of the first through the seventh embodiments, wherein female splines of the upper bore of the coupling assembly are the same as the female splines of the lower bore of the coupling assembly.

A tenth embodiment, which is the ESP seal second of any of the first through the ninth embodiments, further comprising a second O-ring disposed between a circumferential groove in an outside of a lower end of the seal section and an inside surface of an upper end of the service-less flange.

An eleventh embodiment, which is a method of assembling an electric submersible pump (ESP) assembly and running it into a wellbore, comprising hanging an electric motor above the wellbore, wherein the electric motor is filled with dielectric oil and comprises a drive shaft having an upper end that protrudes above the upper end of the electric motor and that defines male splines; lifting a seal section assembly above the electric motor, wherein the seal section assembly comprises a seal section having a drive shaft, wherein the seal section is filled with dielectric oil, a coupling assembly partially inserted into an opening at the lower end of the seal section and having a lower bore defining female splines for mating with the male splines of an upper end of the drive shaft of the electric motor, an upper bore defining female splines for mating with male splines of a lower end of the drive shaft of the seal section, and a coupling body, wherein the coupling body is substantially cylindrical and has a first outside diameter at an upper end of the coupling body, has a second outside diameter smaller than the first diameter below the portion of the coupling body having the first outside diameter, has a circumferential tapered shoulder between the portion of the coupling body having the first diameter and the portion of the coupling body having the second diameter, has a circumferential groove at the lower end of the portion of the coupling body having the second outside diameter, has a third outside diameter smaller than the second diameter below the portion of the coupling body having the second outside diameter, a service-less flange coupled to a lower end of the seal section, wherein the service-less flange defines a circumferential opening having a circumferential tapered shoulder on an upper edge that contacts the circumferential tapered shoulder of the coupling body, a retainer disposed in the circumferential grove of the coupling body that contacts a lower edge of the service-less flange, and an O-ring disposed between a circumferential groove in the circumferential opening of the service-less flange and the portion of the coupling body having the second diameter that provides a seal to retain the dielectric oil within the seal section; removing the retainer from the circumferential groove of the coupling body; lowering the seal section assembly to mate the female splines of the lower bore of the coupling assembly with the male splines of the drive shaft of the electric motor; and urging the coupling assembly upwards into the lower end of the seal section by the first drive shaft, wherein the female splines of the upper bore of the coupling assembly mate with male splines of a drive shaft of the seal section and the seal provided by the O-ring disposed between the circumferential opening of the service-less flange and the portion of the coupling body having the second diameter is released and fluid communication between the seal section and the electric motor is established via an annulus defined between the coupling assembly and an inside wall of the seal section.

A twelfth embodiment, which is the method of the eleventh embodiment, wherein an outside of a lower end of the seal section comprises a second circumferential groove and wherein the seal section assembly comprises a second O-ring disposed between the second circumferential groove and an inner wall of an upper portion of the service-less flange that provides a seal to retain the dielectric oil within the seal section.

A thirteenth embodiment, which is the method of the eleventh or the twelfth embodiment, wherein the O-ring or the second O-ring comprises Nitrile.

A fourteenth embodiment, which is the method of the eleventh or the twelfth embodiment, wherein the O-ring or the second O-ring comprises perfluoroelastomer (FFKM).

A fifteenth embodiment, which is the method of the eleventh or the twelfth embodiment, wherein the O-ring or the second O-ring comprises ethylene propylene diene monomer rubber (EPDM rubber).

A sixteenth embodiment, which is the method of any of the eleventh through the fifteenth embodiment, wherein the O-ring or the second O-ring comprises carbon black.

A seventeenth embodiment, which is the method of any of the eleventh through the sixteenth embodiment, wherein the O-ring or the second O-ring comprises calcium carbonate.

An eighteenth embodiment, which is the method of any of the eleventh through the seventeenth embodiment, wherein the O-ring or the second O-ring comprises plasticisers.

A nineteenth embodiment, which is the method of any of the eleventh through the eighteenth embodiment, further comprising removing an attachment that couples the service-less flange to the lower end of the seal section.

A twentieth embodiment, which is the method of the nineteenth embodiment, wherein the attachment is at least one wire.

A twenty-first embodiment, which is the method of the nineteenth embodiment, wherein the attachment is at least one metal band.

A twenty-second embodiment, which is the method of any of the eleventh through the twenty-first embodiment further comprising bolting the seal section assembly to the electric motor; coupling a fluid inlet to an upper end of the seal section; coupling a centrifugal pump assembly into the ESP assembly; coupling a production tubing string to the ESP assembly; and running the ESP assembly into the wellbore.

A twenty-third embodiment, which is the method of any of the eleventh through the twenty-first embodiment, further comprising bolting the seal section assembly to a motor head coupled to the electric motor; coupling a fluid inlet to an upper end of the seal section; coupling a centrifugal pump assembly into the ESP assembly; coupling a production tubing string to the ESP assembly; and running the ESP assembly into the wellbore.

A twenty-fourth embodiment, which is the method of the twenty-third embodiment, further comprising coupling a lower end of a gas separator to an upper end of the fluid inlet; and coupling an upper end of the gas separator to a lower end of the centrifugal pump.

A twenty-fifth embodiment, which is the method of assembling an electric submersible pump (ESP) assembly and running it into a wellbore, comprising hanging an electric motor above the wellbore, wherein the electric motor is filled with dielectric oil and comprises a drive shaft having an upper end that protrudes above the upper end of a motor head coupled to the upper end of the electric motor and that defines male splines; lifting a seal section assembly above the electric motor, wherein the seal section assembly comprises a seal section having a drive shaft, wherein the seal section is filled with dielectric oil, a coupling assembly partially inserted into an opening at the lower end of the seal section and having a lower bore defining female splines for mating with the male splines of the drive shaft of the electric motor, an upper bore defining female splines for mating with male splines of a lower end of the drive shaft of the seal section, and a coupling body, wherein the coupling body is substantially cylindrical and has a first outside diameter at an upper end of the coupling body, has a second outside diameter smaller than the first diameter below the portion of the coupling body having the first outside diameter, has a circumferential tapered shoulder between the portion of the coupling body having the first diameter and the portion of the coupling body having the second diameter, has a circumferential groove at the lower end of the portion of the coupling body having the second outside diameter, has a third outside diameter smaller than the second diameter below the portion of the coupling body having the second outside diameter, a service-less flange coupled to a lower end of the seal section, wherein the service-less flange defines a circumferential opening having a circumferential tapered shoulder on an upper edge that contacts the circumferential tapered shoulder of the coupling body, a retainer disposed in the circumferential grove of the coupling body that contacts a lower edge of the service-less flange, and a first O-ring disposed between a first circumferential groove in the circumferential opening of the service-less flange and the portion of the coupling body having the second diameter that provides a first seal to retain the dielectric oil within the seal section, a second O-ring disposed in a second circumferential groove in an outside of a lower portion of the service-less flange; removing the retainer from the circumferential groove of the coupling body; lowering the seal section assembly to mate the female splines of the lower bore of the coupling assembly with the male splines of the drive shaft of the electric motor; and urging the coupling assembly upwards into the lower end of the seal section by the drive shaft of the electric motor, wherein the female splines of the upper bore of the coupling assembly mate with the male splines of the drive shaft of the seal section, wherein the second O-ring engages with an inside diameter of the motor head making a second seal, and wherein the first seal provided by the first O-ring disposed between the first circumferential groove in the circumferential opening of the service-less flange and the portion of the coupling body having the second diameter is released after the second seal is established and fluid communication between the seal section and the electric motor is established via an annulus defined between the coupling assembly and an inside wall of the seal section.

A twenty-sixth embodiment, which is the method of the twenty-fifth embodiment, wherein the first O-ring or the second O-ring or both comprises Nitrile.

A twenty-seventh embodiment, which is the method of the twenty-fifth embodiment, wherein the first O-ring or the second O-ring or both comprises perfluoroelastomer (FFKM).

A twenty-eighth embodiment, which is the method of the twenty-fifth embodiment, wherein the first O-ring or the second O-ring or both comprises ethylene propylene diene monomer rubber (EPDM rubber).

A twenty-ninth embodiment, which is the method of any of the twenty-fifth through the twenty-eighth embodiment, wherein the first O-ring or the second O-ring or both comprises carbon black.

A thirtieth embodiment, which is the method of any of the twenty-fifth through the twenty-ninth embodiment, wherein the first O-ring or the second O-ring or both comprises calcium carbonate.

A thirty-first embodiment, which is the method of any of the twenty-fifth through the thirtieth embodiment, wherein the first O-ring or the second O-ring or both comprises plasticisers.

A thirty-second embodiment, which is the method of any of the twenty-fifth through the thirty-first embodiment, further comprising running the ESP assembly into the wellbore.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. An electric submersible pump (ESP) seal section assembly, comprising:

a seal section having a seal section drive shaft, wherein the seal section is filled with dielectric oil;

a coupling body partially inserted into an opening at the lower end of the seal section and having a lower bore defining female splines for mating with male splines of an upper end of an electric motor drive shaft, and an upper bore defining female splines for mating with male splines of a lower end of the seal section drive shaft, wherein the coupling body is substantially cylindrical and has a first outside diameter at an upper end of the coupling body, has a second outside diameter smaller than the first diameter below the portion of the coupling body having the first outside diameter, has a circumferential tapered shoulder between the portion of the coupling body having the first diameter and the portion of the coupling body having the second diameter, has a circumferential groove at the lower end of the portion of the coupling body having the second outside diameter, has a third outside diameter smaller than the second diameter below the portion of the coupling body having the second outside diameter;

a service-less flange coupled to a lower end of the seal section, wherein the service-less flange defines a circumferential opening having a circumferential tapered shoulder on an upper edge that contacts the circumferential tapered shoulder of the coupling body;

a retainer disposed in the circumferential grove of the coupling body that contacts a lower edge of the service-less flange; and an O-ring disposed between a circumferential groove in the circumferential opening of the service-less flange and the portion of the coupling body having the second diameter that provides a seal to retain the dielectric oil within the seal section.

2. The ESP seal section assembly of claim 1, wherein the O-ring comprises Nitrile.

3. The ESP seal section assembly of claim 1, wherein the O-ring comprises perfluoroelastomer (FFKM).

4. The ESP seal section assembly of claim 1, wherein the O-ring comprises ethylene propylene diene monomer rubber (EPDM rubber).

5. The ESP seal section assembly of claim 1, wherein female splines of the upper bore of the coupling assembly are different from the female splines of the lower bore of the coupling assembly.

6. The ESP seal section assembly of claim 1, wherein female splines of the upper bore of the coupling assembly are the same as the female splines of the lower bore of the coupling assembly.

7. The ESP seal section assembly of claim 1, further comprising a second O-ring disposed between a circumferential groove in an outside of a lower end of the seal section and an inside surface of an upper end of the service-less flange.

8. A method of assembling an electric submersible pump (ESP) assembly and running it into a wellbore, comprising:

hanging an electric motor above the wellbore, wherein the electric motor is filled with dielectric oil and comprises a drive shaft having an upper end that protrudes above the upper end of the electric motor and that defines male splines;

lifting a seal section assembly above the electric motor, wherein the seal section assembly comprises a seal section having a drive shaft, wherein the seal section is filled with dielectric oil, a coupling assembly partially inserted into an opening at the lower end of the seal section and having a lower bore defining female splines for mating with the male splines of an upper end of the drive shaft of the electric motor, an upper bore defining female splines for mating with male splines of a lower end of the drive shaft of the seal section, and a coupling body, wherein the coupling body is substantially cylindrical and has a first outside diameter at an upper end of the coupling body, has a second outside diameter smaller than the first diameter below the portion of the coupling body having the first outside diameter, has a circumferential tapered shoulder between the portion of the coupling body having the first diameter and the portion of the coupling body having the second diameter, has a circumferential groove at the lower end of the portion of the coupling body having the second outside diameter, has a third outside diameter smaller than the second diameter below the portion of the coupling body having the second outside diameter, a service-less flange coupled to a lower end of the seal section, wherein the service-less flange defines a circumferential opening having a circumferential tapered shoulder on an upper edge that contacts the circumferential tapered shoulder of the coupling body, a retainer disposed in the circumferential grove of the coupling body that contacts a lower edge of the service-less flange, and an O-ring disposed between a circumferential groove in the circumferential opening of the service-less flange and the portion of the coupling body having the second diameter that provides a seal to retain the dielectric oil within the seal section;

removing the retainer from the circumferential groove of the coupling body;

lowering the seal section assembly to mate the female splines of the lower bore of the coupling assembly with the male splines of the drive shaft of the electric motor; and urging the coupling assembly upwards into the lower end of the seal section by the first drive shaft, wherein the female splines of the upper bore of the coupling assembly mate with male splines of a drive shaft of the seal section and the seal provided by the O-ring disposed between the circumferential opening of the service-less flange and the portion of the coupling body having the second diameter is released and fluid communication between the seal section and the electric motor is established via an annulus defined between the coupling assembly and an inside wall of the seal section.

9. The method of claim 8, wherein an outside of a lower end of the seal section comprises a second circumferential groove and wherein the seal section assembly comprises a second O-ring disposed between the second circumferential groove and an inner wall of an upper portion of the service-less flange that provides a seal to retain the dielectric oil within the seal section.

10. The method of claim 8, further comprising removing an attachment that couples the service-less flange to the lower end of the seal section.

11. The method of claim 10, wherein the attachment is at least one wire.

12. The method of claim 10, wherein the attachment is at least one metal band.

13. The method of claim 8, further comprising:

bolting the seal section assembly to the electric motor;

coupling a fluid inlet to an upper end of the seal section;

coupling a centrifugal pump assembly into the ESP assembly;

coupling a production tubing string to the ESP assembly; and running the ESP assembly into the wellbore.

14. The method of claim 8, further comprising:

bolting the seal section assembly to a motor head coupled to the electric motor;

coupling a fluid inlet to an upper end of the seal section;

coupling a centrifugal pump assembly into the ESP assembly;

coupling a production tubing string to the ESP assembly; and running the ESP assembly into the wellbore.

15. The method of claim 14, further comprising:

coupling a lower end of a gas separator to an upper end of the fluid inlet; and coupling an upper end of the gas separator to a lower end of the centrifugal pump.

16. A method of assembling an electric submersible pump (ESP) assembly and running it into a wellbore, comprising:

hanging an electric motor above the wellbore, wherein the electric motor is filled with dielectric oil and comprises a drive shaft having an upper end that protrudes above the upper end of a motor head coupled to the upper end of the electric motor and that defines male splines;

lifting a seal section assembly above the electric motor, wherein the seal section assembly comprises a seal section having a drive shaft, wherein the seal section is filled with dielectric oil, a coupling assembly partially inserted into an opening at the lower end of the seal section and having a lower bore defining female splines for mating with the male splines of the drive shaft of the electric motor, an upper bore defining female splines for mating with male splines of a lower end of the drive shaft of the seal section, and a coupling body, wherein the coupling body is substantially cylindrical and has a first outside diameter at an upper end of the coupling body, has a second outside diameter smaller than the first diameter below the portion of the coupling body having the first outside diameter, has a circumferential tapered shoulder between the portion of the coupling body having the first diameter and the portion of the coupling body having the second diameter, has a circumferential groove at the lower end of the portion of the coupling body having the second outside diameter, has a third outside diameter smaller than the second diameter below the portion of the coupling body having the second outside diameter, a service-less flange coupled to a lower end of the seal section, wherein the service-less flange defines a circumferential opening having a circumferential tapered shoulder on an upper edge that contacts the circumferential tapered shoulder of the coupling body, a retainer disposed in the circumferential grove of the coupling body that contacts a lower edge of the service-less flange, and a first O-ring disposed between a first circumferential groove in the circumferential opening of the service-less flange and the portion of the coupling body having the second diameter that provides a first seal to retain the dielectric oil within the seal section, a second O-ring disposed in a second circumferential groove in an outside of a lower portion of the service-less flange;

removing the retainer from the circumferential groove of the coupling body;

lowering the seal section assembly to mate the female splines of the lower bore of the coupling assembly with the male splines of the drive shaft of the electric motor; and urging the coupling assembly upwards into the lower end of the seal section by the drive shaft of the electric motor, wherein the female splines of the upper bore of the coupling assembly mate with the male splines of the drive shaft of the seal section, wherein the second O-ring engages with an inside diameter of the motor head making a second seal, and wherein the first seal provided by the first O-ring disposed between the first circumferential groove in the circumferential opening of the service-less flange and the portion of the coupling body having the second diameter is released after the second seal is established and fluid communication between the seal section and the electric motor is established via an annulus defined between the coupling assembly and an inside wall of the seal section.

17. The method of claim 16, wherein the first O-ring and the second O-ring comprise Nitrile.

18. The method of claim 16, wherein the first O-ring or the second O-ring or both comprise perfluoroelastomer (FFKM).

19. The method of claim 16, wherein the first O-ring and the second O-ring or both comprise ethylene propylene diene monomer rubber (EPDM rubber).

20. The method of claim 16, further comprising running the ESP assembly into the wellbore.

* * * * *